US008608040B2

(12) United States Patent
Cheesman et al.

(10) Patent No.: US 8,608,040 B2
(45) Date of Patent: Dec. 17, 2013

(54) HARNESS FOR BREATHING APPARATUS

(75) Inventors: David Cheesman, Northumberland (GB); James Farnaby, Tyne and Wear (GB)

(73) Assignee: Draeger Safety UK Limited, Blyth (Northumberland) (GB)

( * ) Notice: Subject to any disclaimer, the term of this patent is extended or adjusted under 35 U.S.C. 154(b) by 313 days.

(21) Appl. No.: 12/773,419

(22) Filed: May 4, 2010

(65) Prior Publication Data

US 2010/0282252 A1 Nov. 11, 2010

(30) Foreign Application Priority Data

May 6, 2009 (GB) ..... 0907754.6

(51) Int. Cl.
*A62B 9/04* (2006.01)

(52) U.S. Cl.
USPC ..... 224/629; 224/628; 224/934; 224/633

(58) Field of Classification Search
USPC ..... 224/624, 943, 627–628, 148.2, 633, 224/637; 405/185–187; 128/205.22
See application file for complete search history.

(56) References Cited

U.S. PATENT DOCUMENTS

| | | | | |
|---|---|---|---|---|
| 5,106,236 | A * | 4/1992 | Hancock et al. | 405/186 |
| 6,749,369 | B2 * | 6/2004 | Garofalo | 405/186 |
| 7,198,186 | B2 * | 4/2007 | Kling et al. | 224/628 |
| 2004/0045991 | A1 | 3/2004 | Kling et al. | |
| 2005/0123357 | A1 * | 6/2005 | Canella | 405/186 |
| 2008/0179366 | A1 | 7/2008 | Hogg | |
| 2008/0257928 | A1 * | 10/2008 | Lowry et al. | 224/638 |

FOREIGN PATENT DOCUMENTS

| | | | |
|---|---|---|---|
| EP | 1 952 718 A1 | 8/2008 | A45F 3/10 |
| EP | 1 952 719 A1 | 8/2008 | A45F 3/10 |

OTHER PUBLICATIONS

Search report under Section 17 for GB0907754.6, date of search Aug. 21, 2009, 2 pp.

* cited by examiner

*Primary Examiner* — Adam Waggenspack
(74) *Attorney, Agent, or Firm* — DLA Piper LLP (US)

(57) ABSTRACT

A harness for breathing apparatus, comprising a structural support member 10 having a front for accommodating a gas cylinder and a rear for facing the back of a wearer, and left and right sides. Left and right shoulder straps 110, 120 are disposed towards the left and right sides of the structural support member respectively, and each shoulder strap has a first end attached to an upper portion of the structural support member and a second end attached to a lower portion of the structural support member. A plurality of flexible conduits 140, 150 extend from a lower portion of the structural support member along the structural support member, each to a position on either the left or right shoulder strap. Left and right guide channels 30, 32 extend longitudinally along the structural support member along left and right sides respectively, for accommodating the flexible conduits.

10 Claims, 11 Drawing Sheets

HARNESS FOR BREATHING APPARATUS

This application is a utility application which claims the priority of United Kingdom Patent Application No. GB 0907754.6, filed May 6, 2009 incorporated herein by reference in its entirety.

BACKGROUND OF THE INVENTION

The present invention relates to a harness for breathing apparatus, in particular, a harness for breathing apparatus having a structural support member comprising guide channels for flexible conduits.

Self-contained breathing apparatus (SCBA) harnesses comprise a structural support member in the form of a back plate (or back frame), a pair of shoulder straps and a waist belt. The back plate is provided with a valve towards the lower end and a retaining strap. In use, a cylinder of breathable gas is attached to the valve and is secured to the back plate by means of the retaining strap. A number of flexible hoses extend from the valve to the shoulder straps so that breathing apparatus worn by the user may be conveniently connected thereto.

It is known to provide channels on the back plate for guiding the flexible hoses from the valve to the shoulder strap. The positions of these channels usually determine which of the shoulder straps the hoses are positioned on. However, individual users, or groups of users, have different preferences as to where the hoses are positioned.

For example, certain fire-fighting brigades specify that all of the hoses must be worn on the left shoulder strap whilst other brigades specify that the hoses must be worn on the right shoulder strap. Further, an individual may prefer to have one of the hoses on the left shoulder and another on the right.

In order to accommodate individual users', or groups of users', preferences, either differently configured back plates must be produced, which is expensive, or the hoses must be routed out of the guide channels, which can result in the hoses presenting a snagging risk.

It is therefore desirable to provide a versatile back plate.

SUMMARY OF THE INVENTION

According to a first aspect of the present invention there is provided a harness for breathing apparatus, comprising: a structural support member having a front for accommodating a gas cylinder and a rear for facing the back of a wearer and left and right sides; left and right shoulder straps disposed towards the left and right sides of the structural support member respectively, each shoulder strap having a first end attached to an upper portion of the structural support member and a second end attached to a lower portion of the structural support member; a plurality of flexible conduits extending from a lower portion of the structural support member along the structural support member each to a position on either the left or right shoulder strap; and left and right guide channels extending longitudinally along the structural support member along left and right sides respectively, for accommodating the flexible conduits; wherein at least one of the guide channels is arranged to accommodate at least two flexible conduits.

The left guide channel and the right guide channel may each be arranged to accommodate at least two flexible conduits. The harness may further comprise a cross guide channel extending transversely across the structural support member from one side to the other side for accommodating at least one flexible conduit. The cross guide channel preferably extends across an upper portion of the structural support member.

The guide channels may be located on the rear of the structural support member.

In a preferred embodiment, at least one of the flexible conduits extends from the front of the lower portion of the structural support member and passes through an opening in the back plate to the rear of the structural support member before extending along the structural support member in a guide channel.

Retaining means may be provided for retaining the or each flexible conduit in the or each guide channel. The retaining means may comprise clamping elements provided in the or each guide channel. Alternatively or additionally, the or each guide channel may be shaped to provide the retaining means.

In a preferred embodiment, the upper portion of the structural support member comprises a yoke portion having left and right shoulder strap attachment portions to which the first ends of the left and right shoulder straps are attached respectively, at least one of the shoulder strap attachment strap portions having first and second guide channels arranged to guide the or each flexible conduit to the position on the respective shoulder strap. The left and right shoulder strap attachment portions may each have first and second guide channels.

The or each flexible conduit may be arranged to be held between a guide channel of the yoke portion and a shoulder strap.

The flexible conduits may include a high-pressure hose and a medium-pressure hose. The flexible conduits may include one or more electrical cables.

According to a further aspect of the present invention there is provided a harness for breathing apparatus, comprising: a structural support member having a front for accommodating a gas cylinder and a rear for facing the back of a wearer, and left and right sides; left and right shoulder straps disposed towards the left and right sides of the structural support member respectively, each shoulder strap having a first end attached to an upper portion of the structural support member and a second end attached to a lower portion of the structural support member; a plurality of flexible conduits extending from a lower portion of the structural support member along the structural support member each to a position on either the left or right shoulder strap; left and right guide channels extending longitudinally along the structural support member along left and right sides respectively, for accommodating the flexible conduits; and a cross guide channel, extending transversely across an upper region of the structural support member from one side to the other side for accommodating at least one flexible conduit; wherein the cross guide channel has a first end adjacent to an upper end of the left guide channel and a second end adjacent to an upper end of the right guide channel. Preferably at least one of the left and right guide channels is arranged to accommodate at least two flexible conduits.

The invention may comprise any combination of the features and/or limitations referred to herein, except combinations of such features as are mutually exclusive.

BRIEF DESCRIPTION OF THE DRAWINGS

Embodiments of the present invention will now be described, by way of example only, with reference to the accompanying drawings, in which.

DESCRIPTION OF EMBODIMENTS OF THE INVENTION

Figure 1:
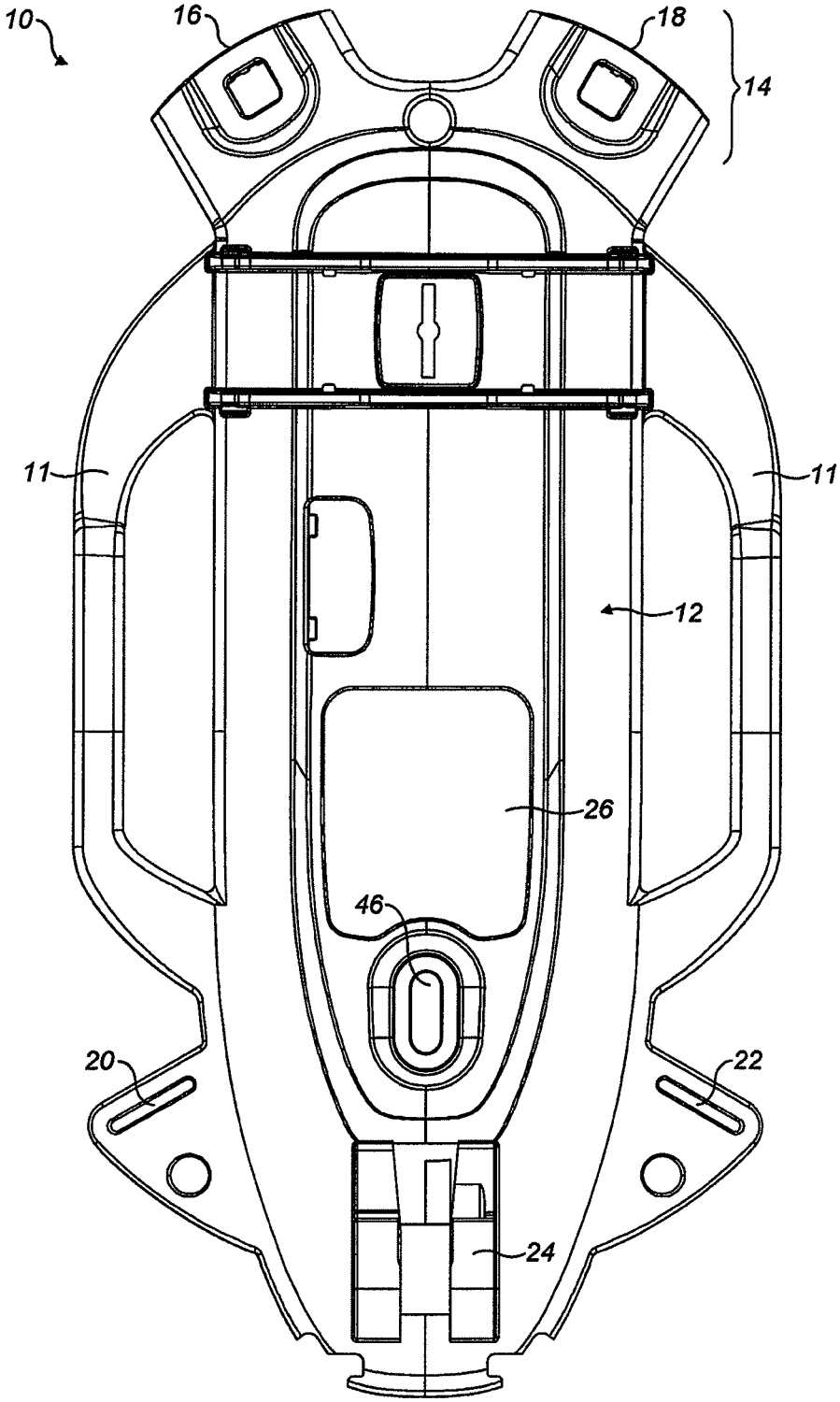
FIG. 1 schematically shows a front view of a back plate for a harness for breathing apparatus according to an embodiment of the present invention.

FIG. 1 shows a structural support member 10 (hereinafter referred to as a back plate) for a harness for breathing apparatus. The back plate 10 has a front face 12 which is arranged to have a cylinder of breathable gas mounted thereto. The back plate has a yoke 14 in an upper region of the back plate 10. The yoke 14 comprises left and right shoulder strap attachment portions 16, 18 that allow the upper ends of left and right shoulder straps to be attached to the back plate 10. Towards a lower end of the back plate 10 there is provided left and right shoulder strap attachment portions 20, 22 that allow the lower ends of left and right shoulder straps to be attached to the back plate 10.

The lower portion of the back plate 10 also comprises a reducer-valve mounting portion 24 which allows a gas-cylinder reducer valve to be mounted to the back plate 10. An opening 26 is provided in the back plate through which in use, flexible conduits can pass. First and second side handles, or legs 11, are provided which enable the back plate 10 to be carried by a user.

Figure 2:
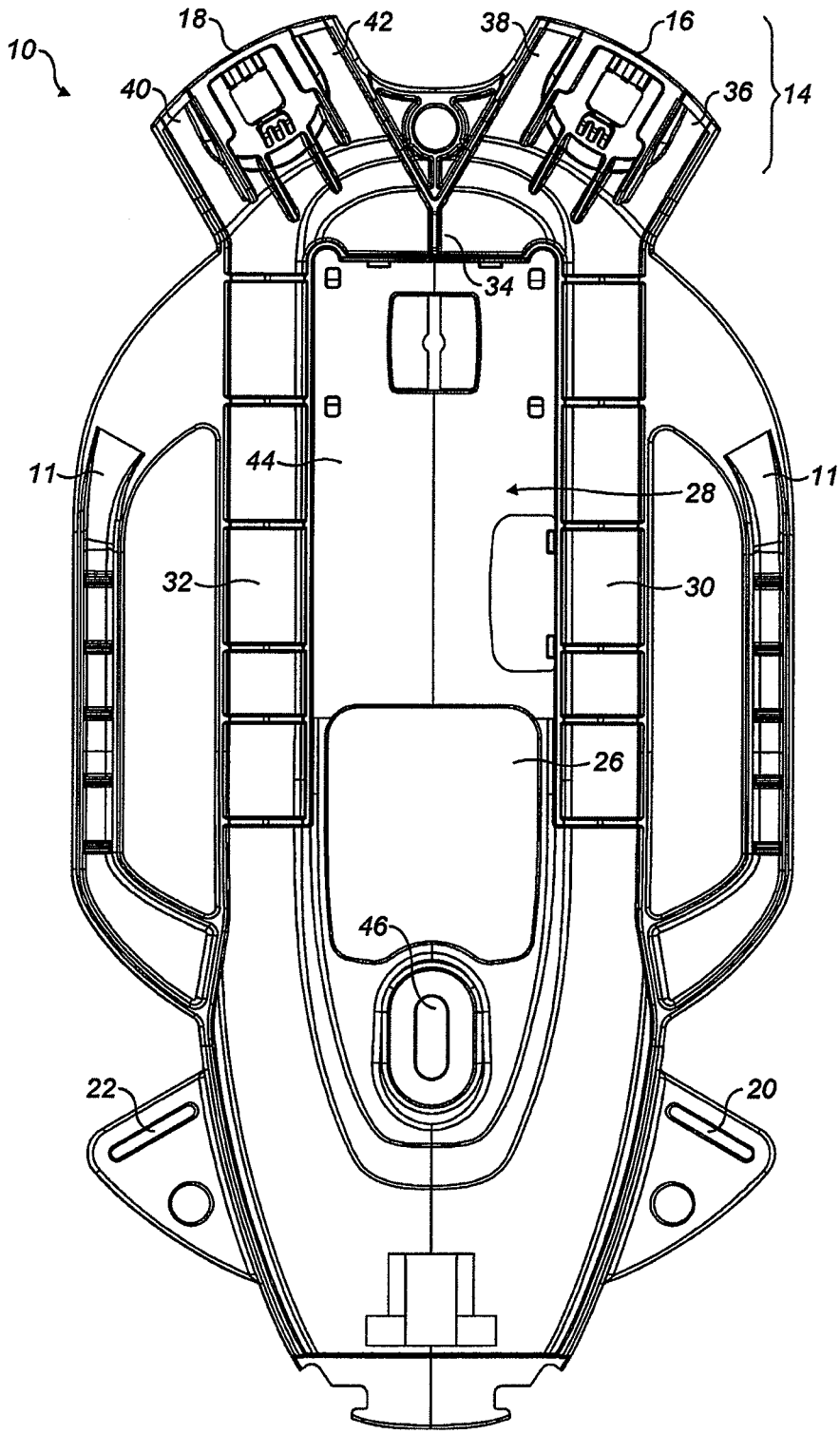
FIG. 2 schematically shows a rear view of the back plate of FIG. 1.

FIG. 2 shows the rear side 28 of the back plate 10. The rear side 28 of the back plate 10 comprises left and right guide channels 30, 32 that extend longitudinally along the left and right sides of the back plate 10 respectively, from a lower portion to an upper portion. A cross guide channel 34 is also provided that extends transversely across the back plate 10 from a left side to a right side. The left (or first) end of the cross guide channel 34 is adjacent to the upper end of the left guide channel 30 and the right (or second) end of the cross guide channel 34 is adjacent to the end of the upper right guide channel 32.

In this embodiment the left and right guide channels 30, 32 are each arranged to accommodate two flexible conduits. The left and right guide channels 30, 32 may in other embodiments comprise a first left channel and a second left channel, and a first right channel and a second right channel. For flexibility, at least one of the left and right guide channels is arranged to accommodate at least two flexible conduits.

The guide channels 30, 32 are shaped with projections within and along their length that are arranged to retain flexible conduits within the channels. However, as will be readily apparent to one skilled in the art, other means for retaining flexible conduits within the channels are possible.

The left and right shoulder strap attachment portions 16, 18 of the yoke 14 are also adjacent to the upper ends of the left and right guide channels 30, 32 respectively. The left shoulder strap attachment portion 16 is provided with first and second guide channels 36, 38 and the right shoulder strap attachment portion 18 is also provided with first and second guide channels 40, 42.

A recess 44 is provided in a central portion of the rear side 28 of the back plate 10. The recess 44 is arranged to accommodate breathing apparatus accessories such as a battery, a pressure transducer or a radio telemetry device, for example. The recess 44 separates the left and right guide channels 30, 32.

A waist belt mounting portion 46 is also provided on the rear side 28 of the back plate 10 which enables a waist belt to be pivotally mounted to the back plate 10.

Figure 3:
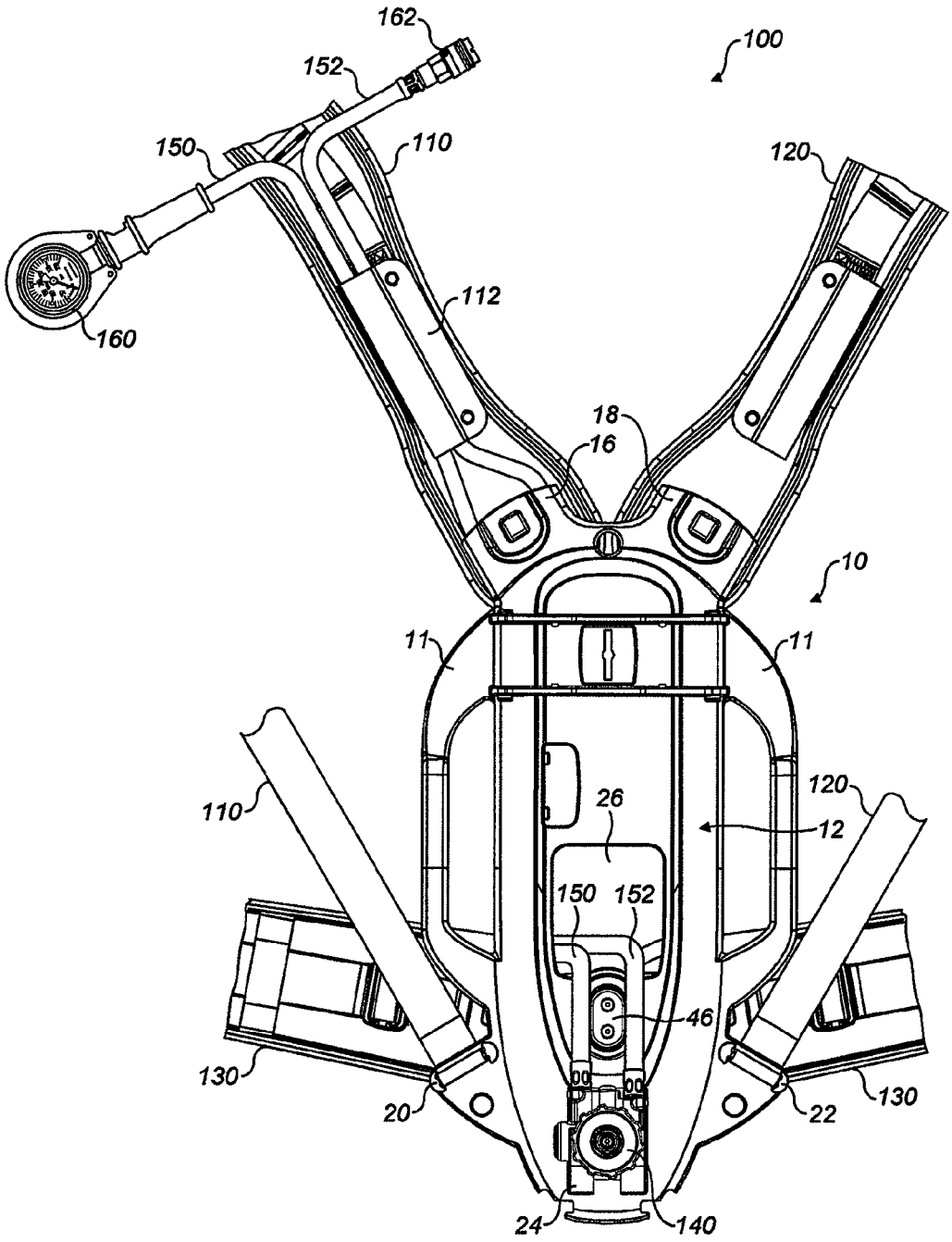
FIG. 3 schematically shows a front view of a harness for breathing apparatus comprising the back plate of FIGS. 1 and 2.

FIG. 3 shows a harness 100 comprising the back plate 10 as described above. Left and right shoulder straps 110, 120 are attached to the shoulder strap fixing portions 16, 18, 20, 22 and a waist belt 130 is attached to the waist belt mounting portion 46. A gas-cylinder reducer valve 140 is attached to a lower portion of the back plate 10 using the reducer valve mounting portion 24. In this embodiment two flexible conduits 150, 152 extend from the reducer valve 140 to a position on the left shoulder strap 110. The flexible conduits comprise a high-pressure hose 150 and a medium-pressure hose 152. In use, a cylinder of breathable gas (not shown) is mounted to the front 12 of the back plate 10 and is attached at a first end to the reducer valve 140 and at a second end is retained on the back plate 10 using a cylinder-retaining strap (not shown). Breathable gas is delivered through the high-pressure hose 150 to a pressure gauge 160 and through the medium-pressure hose 152 to a connector 162 which can be attached to a breathing mask (not shown). As shown in FIG. 3, the flexible conduits 150, 152 pass from the front 12 of the back plate 10 to the rear 28 of the back plate 10 through the opening 26.

Figure 4:
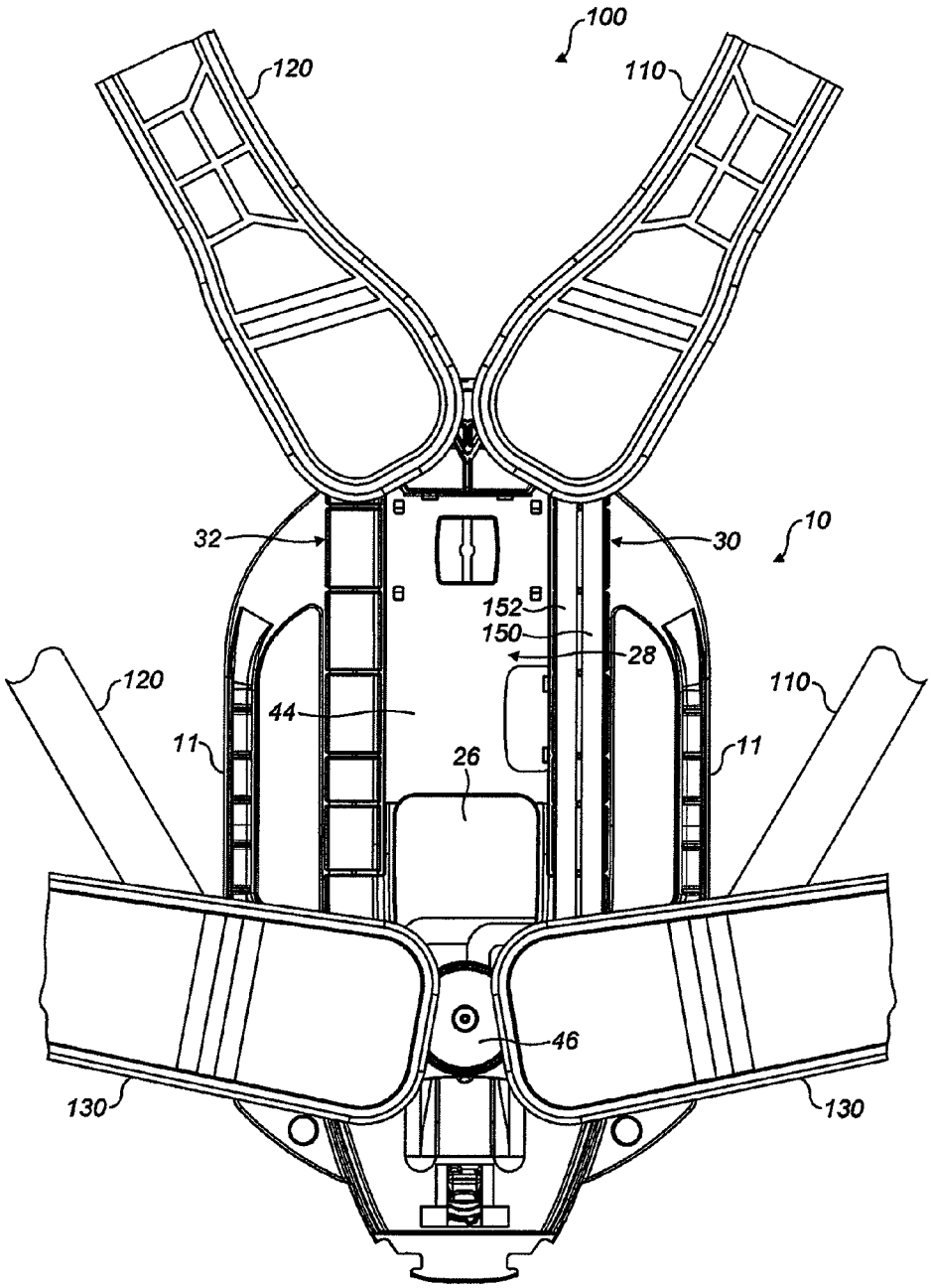
FIG. 4 schematically shows a rear view of the harness of FIG. 3.
Figure 5:
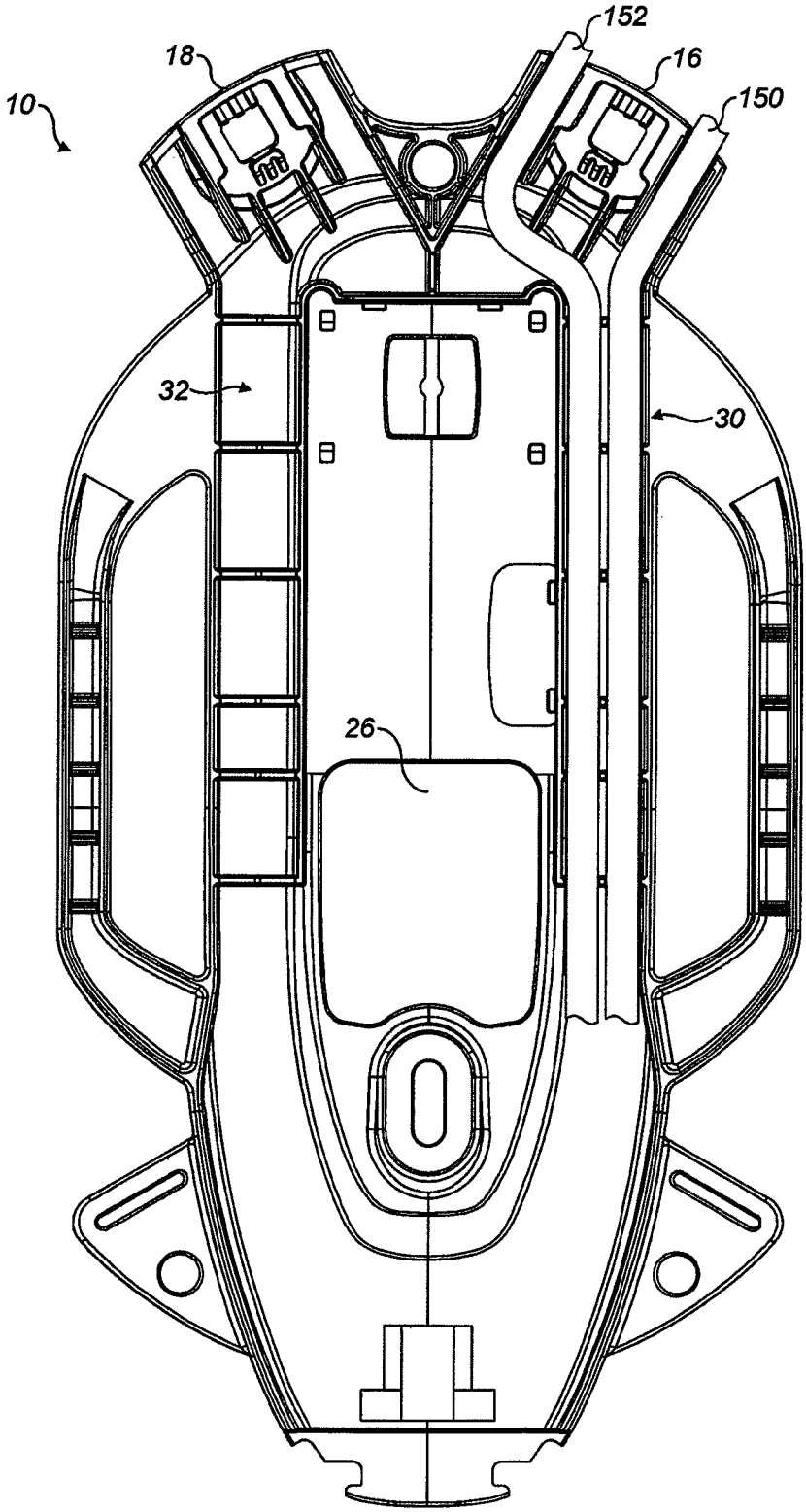
FIG. 5 schematically shows a rear view of the back plate alone with flexible conduits located in guide channels in a first configuration.

Referring now to FIG. 4, the high-pressure hose 150 and the medium-pressure hose 152 are located in the left guide channel 30 in the rear side 28 of the back plate 10. They both extend longitudinally up the left side of the back plate 10 in the left guide channel 30. As shown in FIG. 5, the high-pressure hose 150 exits the left guide channel 30 and passes into the first guide channel 36 of the left shoulder strap attachment portion 16 and the medium-pressure hose 152 exits the left guide channel 30 and passes into the second guide channel 38 of the left shoulder strap attachment portion 16. The hoses 150, 152 are retained in the first and second guide channels 36, 38 by the shoulder strap 110. The hoses 150, 152 then extend down the shoulder strap 110 as shown in FIG. 3 and are held in place by a flap 112.

Figure 6:
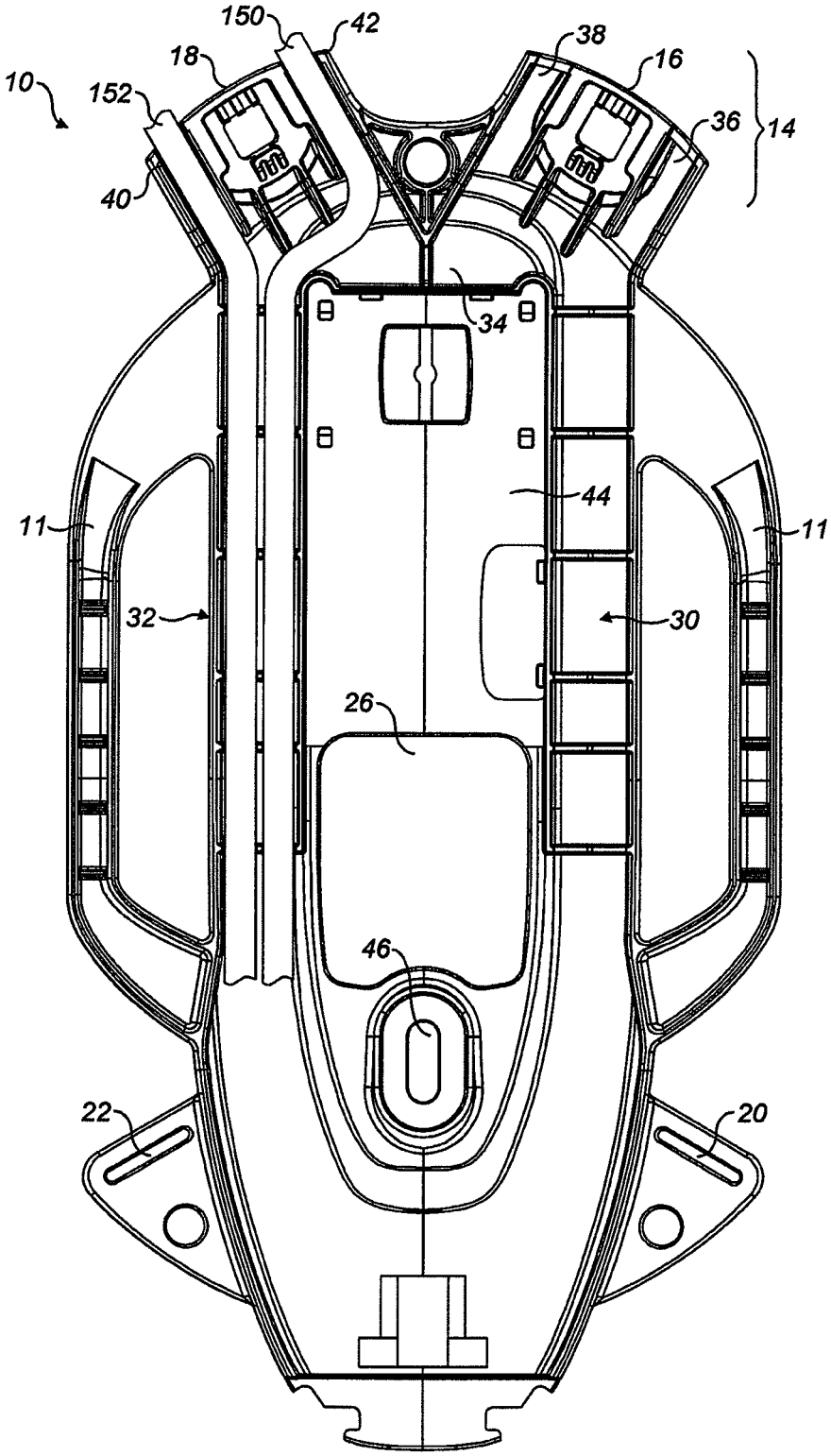
FIG. 6 schematically shows a rear view of the back plate alone with flexible conduits located in guide channels in a second configuration.

As shown in FIG. 6, if the wearer desires, the high-pressure hose 150 and the medium-pressure hose 152 can be taken out of the left guide channel 30 and located in the right guide channel 32. The hoses 150, 152 are then located in the first and second guide channels 40, 42 of the right shoulder strap attachment portion 18. This allows the high-pressure hose 150 and the medium-pressure hose 152 to be located on the right shoulder strap 120.

Figure 7:
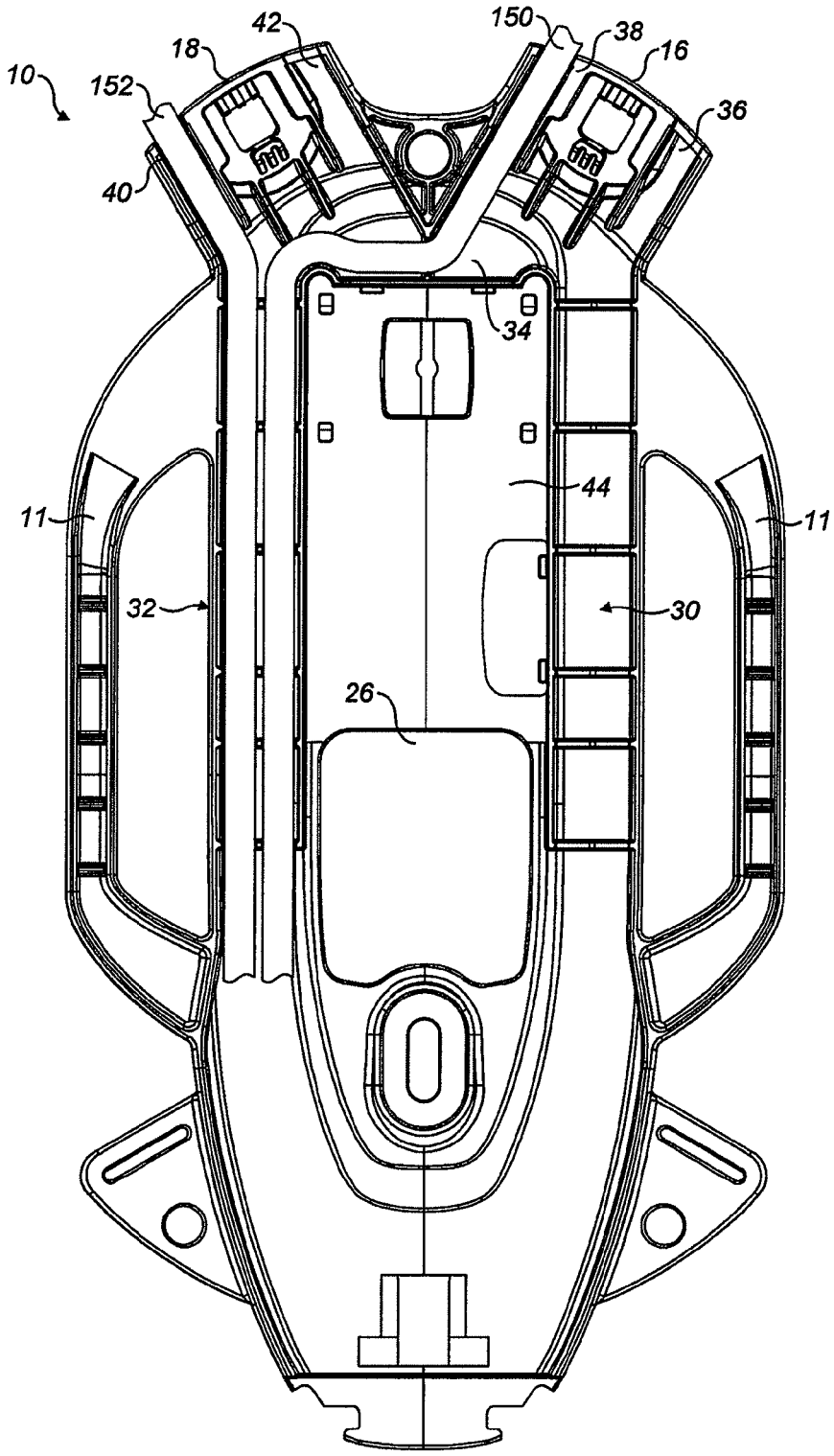
FIG. 7 schematically shows a rear view of the back plate alone with flexible conduits located in guide channels in a third configuration.

In a further configuration and as shown in FIG. 7, the high-pressure hose 150 and the medium-pressure hose 152 are located in the right guide channel 32. The high-pressure hose 150 is then located in the cross guide channel 34 to take it from the right side of the back plate 10 to the left side of the back plate 10. The high-pressure hose 150 is then located in the second guide channel 28 of the left shoulder strap attachment portion 16. The medium-pressure hose is located in the first guide channel 40 of the right shoulder strap attachment portion 18. This allows the high-pressure hose 150 to be located on the left shoulder strap 110 and the medium-pressure hose 152 to be located on the right shoulder strap 120.

As will be readily apparent to one skilled in the art, other configurations are possible with the guide channel arrangements provided in the back plate.

Figure 8:
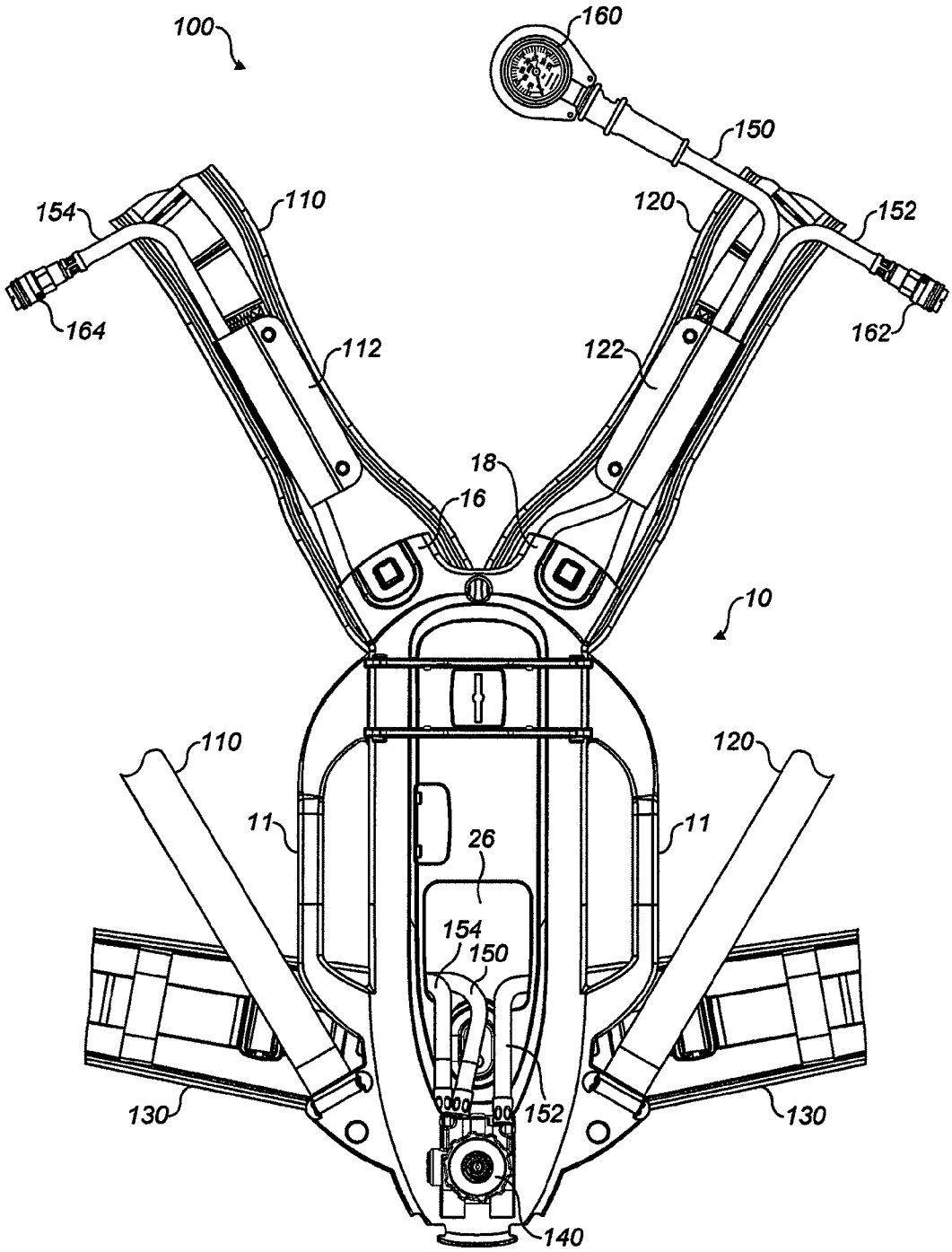
FIG. 8 schematically shows a front view of a harness for breathing apparatus comprising the back plate of FIGS. 1 and 2 in an alternative arrangement.

As shown in FIG. 8, in a second configuration three flexible conduits 150, 152, 154 extend from the reducer 140 mounted to the back plate 10. A second medium-pressure hose 154 is provided to allow a second user's breathing mask to be attached in an emergency. The three hoses 150, 152, 154 pass through the opening 26 in the back plate 10 to the rear side 28 of the back plate. A high-pressure hose 150 extends to a position on the right shoulder strap 120, a first medium-pressure hose 152 extends to a position on the right shoulder strap 120 and a second medium-pressure hose 154 extends to a position on the left shoulder strap 110. The hoses 150, 152, 154 are held in place by flaps 112, 122.

Figure 9:
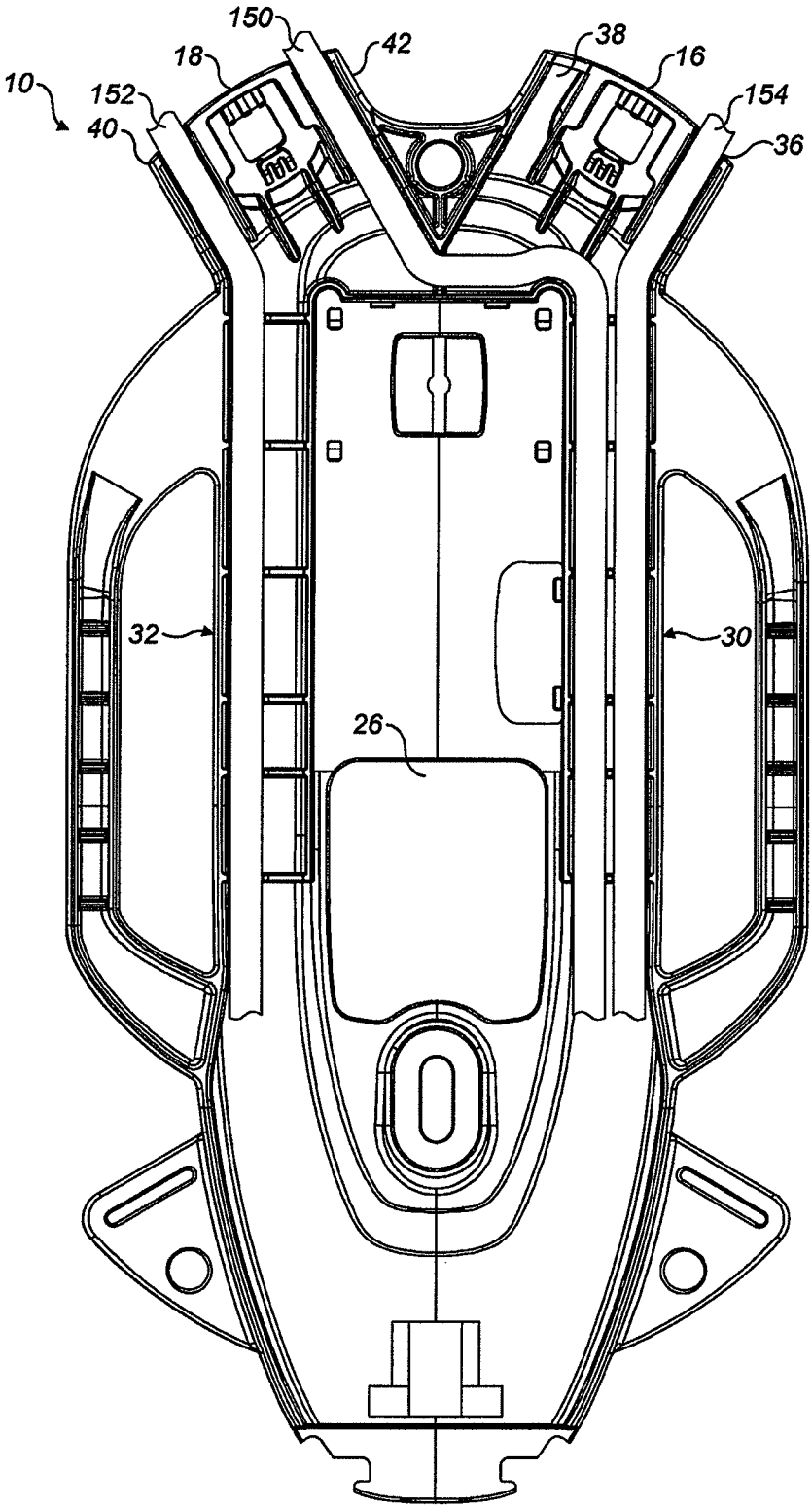
FIG. 9 schematically shows a rear view of the back plate alone with flexible conduits located in guide channels in a first configuration.

Referring to FIG. 9, the high-pressure hose 150 and the second medium-pressure hose 154 are located in the left guide channel 30 in the rear side 28 of the back plate 10. The first medium-pressure hose 152 is located in the right guide channel 32. The high-pressure hose 150 is then located in the cross guide channel 34 which takes it from the left side of the back plate 10 to the right side of the back plate 10. The high-pressure hose 150 is then located in the second guide channel 42 of the right shoulder strap attachment portion 18. The first and second medium-pressure hoses 152, 154 are located in the first guide channels 40, 36 of the right and left shoulder strap attachment portions 18, 16 respectively.

Figure 10:
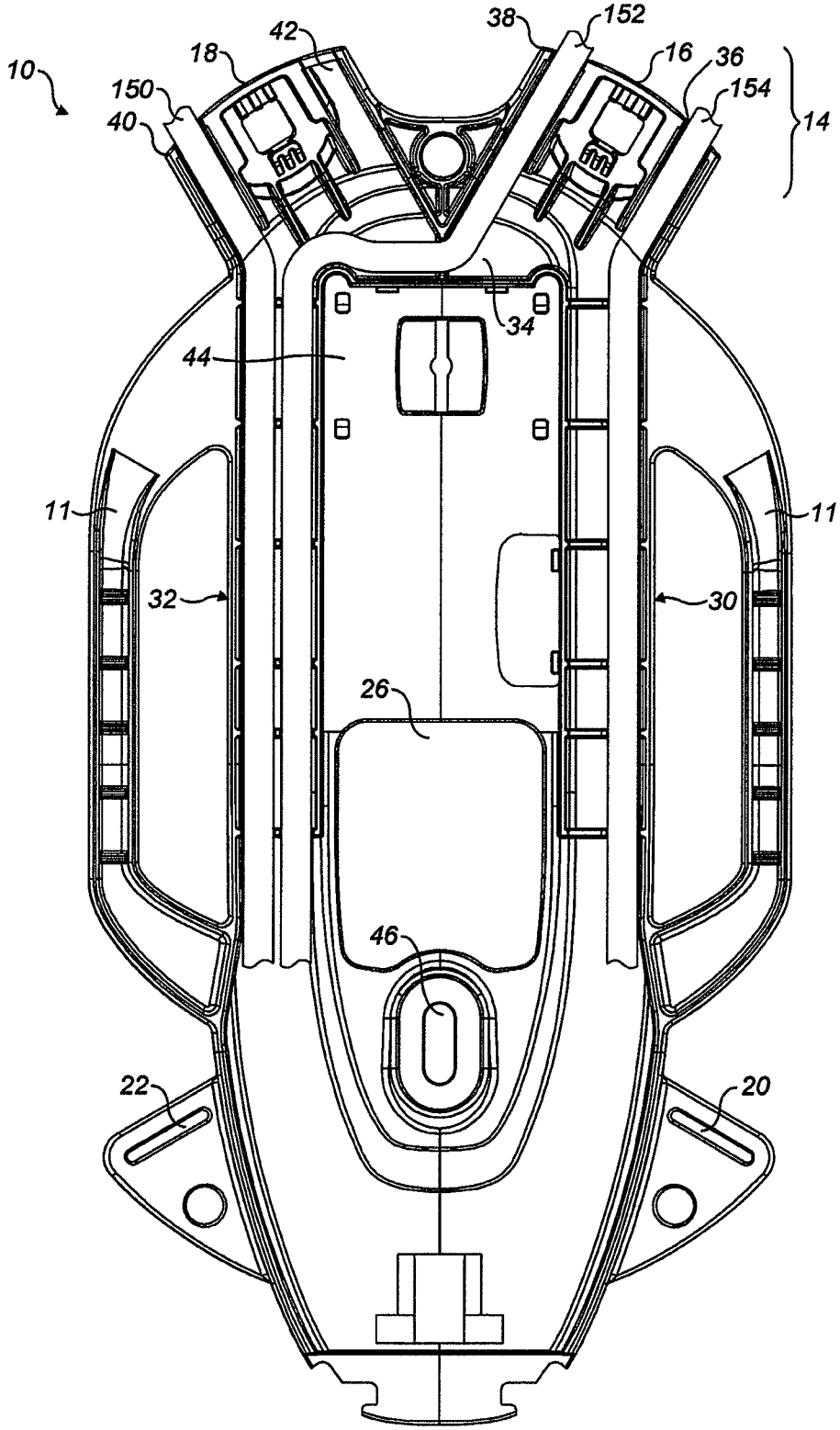
FIG. 10 schematically shows a rear view of the back plate alone with flexible conduits located in guide channels in a second configuration.

In a further configuration shown in FIG. 10, the high-pressure hose 150 and the first medium-pressure hose 152 are located in the right guide channel 32 and the second medium-pressure hose 154 is located in the left guide channel 30. The first medium-pressure hose 152 then extends from the right side of the back plate 10 to the left side of the back plate 10 in the cross guide channel 34. The high-pressure hose 150 is located in the first guide channel 40 of the right shoulder strap attachment portion 18 and the first and second medium-pressure hoses 152, 154 are located in the guide channels 16, 18 of the left shoulder strap attachment portion 16. This allows the high-pressure hose 150 to be located on the right shoulder strap 120 and the first and second medium-pressure hoses 152, 154 to be located on the left shoulder strap 110.

As will be readily apparent to one skilled in the art, other configurations of the hoses in the guide channels provided are possible.

Figure 11:
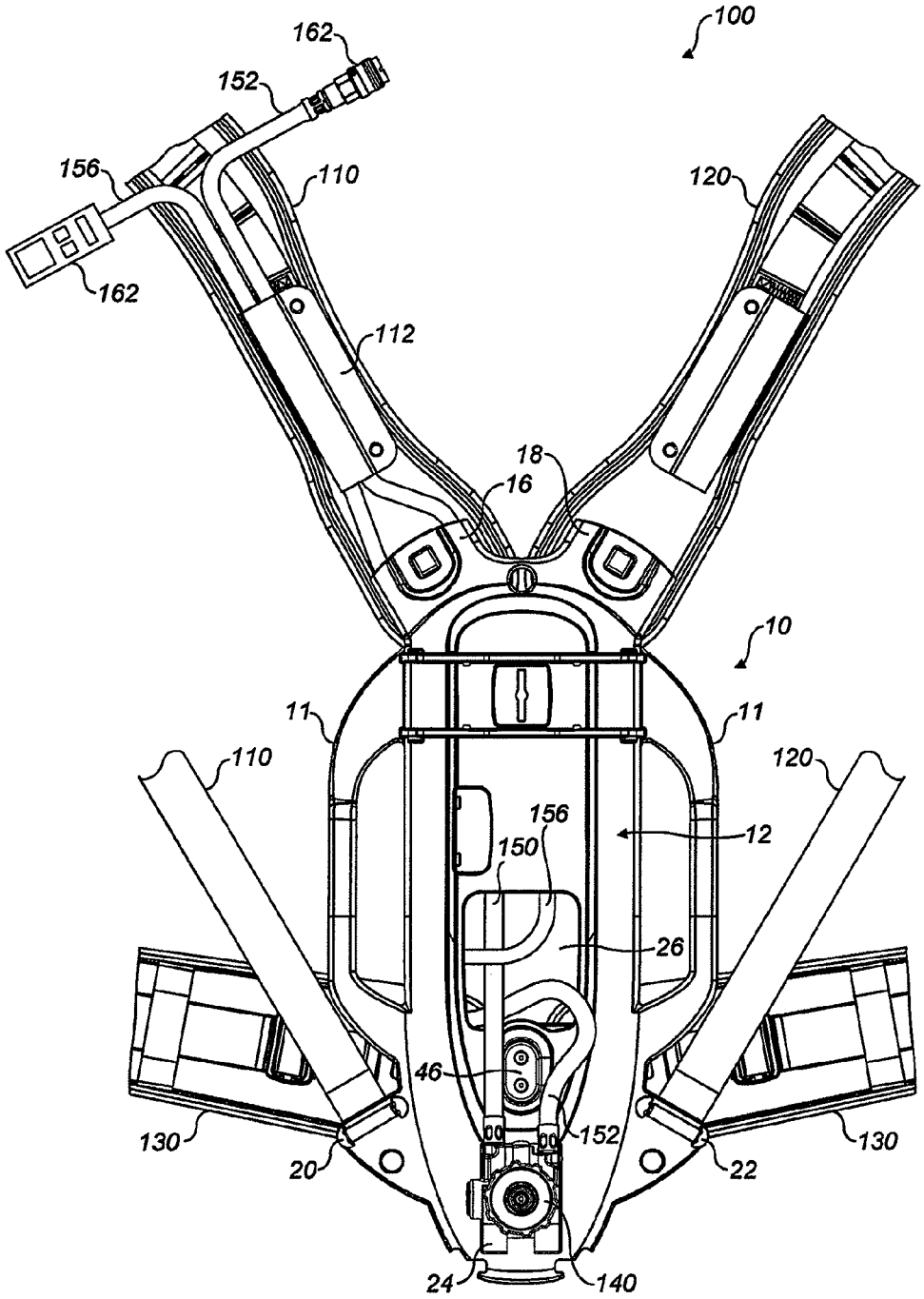
FIG. 11 schematically shows a front view of the back plate alone with flexible conduits located in guide channels in a third configuration.

As shown in FIG. 11, in an alternative arrangement the high-pressure hose 150 extends from the reducer 140 and is attached to a pressure transducer (not shown) that converts the pressure delivered by the hose 150 into an electrical signal. The electrical signal is output through an electrical cable 156 which is located in the left guide channel 30. The electrical cable 156 is positioned on the left shoulder strap 110 and is attached to an electronic display device 162.

The arrangement of the guide channels allows a user to configure his breathing apparatus to suit his particular needs or preferences. Different users prefer different arrangements and different breathing apparatuses have different numbers of hoses. The back plate 10 according to the present invention allows a wide range of hose configurations.

The invention claimed is:

1. A harness for breathing apparatus, comprising:

a structural support member having a front for accommodating a gas cylinder and a rear for facing the back of a wearer, and left and right sides;

left and right shoulder straps disposed towards the left and right sides of the structural support member respectively, each shoulder strap having a first end attached to an upper portion of the structural support member and a second end attached to a lower portion of the structural support member;

a plurality of flexible conduits extending from a lower portion of the structural support member along the structural support member, each to a position on either the left or right shoulder strap;

left and right guide channels extending longitudinally along the structural support member along left and right sides respectively and accommodating the flexible conduits, at least one of the left and right guide channels being arranged to accommodate at least two flexible conduits; and a cross guide channel, extending transversely across an upper region of the structural support member from one side to the other side for accommodating at least one flexible conduit;

wherein the cross guide channel has a first end adjacent to an upper end of the left guide channel and a second end adjacent to an upper end of the right guide channel;

wherein the upper portion of the structural support member comprises a yoke portion having left and right shoulder strap attachment portions to which the first end of the left and right shoulder straps are attached respectively, one of the shoulder strap attachment portions having first and second guide channels arranged to guide one or more of the flexible conduits to the position on the respective shoulder strap.

2. A harness for breathing apparatus according to claim 1, wherein the left guide channel and the right guide channel are each arranged to accommodate at least two flexible conduits.

3. A harness for breathing apparatus according to claim 1, wherein the guide channels are located on the rear of the structural support member.

4. A harness for breathing apparatus according to claim 3, wherein at least one of the flexible conduits extends from the front of the lower portion of the structural support member and passes through an opening in the back plate to the rear of the structural support member before extending along the structural support member in a guide channel.

5. A harness for breathing apparatus according to claim 1, further comprising retaining means for retaining one or more of the flexible conduits in the left and/or right guide channel.

6. A harness for breathing apparatus according to claim 5, wherein the retaining means comprises clamping elements provided in the left and/or right guide channel.

7. A breathing apparatus harness according to claim 5, wherein the left and/or right guide channel is shaped to provide the retaining means.

8. A harness for breathing apparatus according to claim 1, wherein the flexible conduits include a high-pressure hose and a medium-pressure hose.

9. A harness for breathing apparatus according to claim 1, wherein the flexible conduits include one or more electrical cables.

10. Breathing apparatus equipment including a harness arranged to receive a cylinder of breathable gas, the harness comprising:

a structural support member having a front for accommodating a cylinder of breathable gas and a rear for facing the back of a wearer, and left and right sides, a reducer valve being mounted to the structural support member for connecting to the cylinder of breathable gas;

a yoke portion at the upper portion of the structural support member having left and right shoulder strap attachment portions for attaching left and right shoulder straps respectively;

left and right shoulder straps disposed towards the left and right sides of the structural support member respectively, each shoulder strap having a first end attached to a respective shoulder strap attachment portion of the yoke portion on the rear side of the structural support member, and a second end attached to a lower portion of the structural support member;

a plurality of flexible conduits extending from the reducer valve along the structural support member, each to a position on either the left or right shoulder strap;

left and right guide channels extending longitudinally along the structural support member along left and right sides respectively and accommodating the flexible conduits, both the left and right guide channels being arranged to accommodate at least two flexible conduits; and a cross guide channel, extending transversely across an upper region of the structural support member from one side to the other side for accommodating at least one flexible conduit;

wherein the cross guide channel has a first end adjacent to an upper end of the left guide channel and a second end adjacent to an upper end of the right guide channel;

wherein each of the shoulder strap attachment portions have first and second guide channels which accommodate the flexible conduits and guide them over the shoulder straps to the respective positions on the shoulder straps, the flexible conduits being held between the shoulder strap and one of the first and second guide channels.

* * * * *